US007302955B2

(12) United States Patent
Malone

(10) Patent No.: US 7,302,955 B2
(45) Date of Patent: Dec. 4, 2007

(54) SELECTIVELY TOBACCO SHORTENED CIGARETTE AND METHOD OF USE

(75) Inventor: Nolan A. Malone, Arleta, CA (US)

(73) Assignees: Gary Pallino, Las Vegas, NV (US); Andon Malone, Las Vegas, NV (US)

( * ) Notice: Subject to any disclaimer, the term of this patent is extended or adjusted under 35 U.S.C. 154(b) by 304 days.

(21) Appl. No.: 10/429,402

(22) Filed: May 6, 2003

(65) Prior Publication Data

US 2004/0221860 A1 Nov. 11, 2004

(51) Int. Cl.
*A24F 47/00* (2006.01)

(52) U.S. Cl. ..... 131/360; 131/270; 131/361

(58) Field of Classification Search ..... 131/270, 131/360, 361, 364; 206/246, 496
See application file for complete search history.

(56) References Cited

U.S. PATENT DOCUMENTS 2,389,104 A * 11/1945 Bauer et al. ..... 131/360
3,439,685 A * 4/1969 Allen ..... 131/270
5,105,835 A * 4/1992 Drewett et al. ..... 131/349
5,197,495 A * 3/1993 Ruppert et al. ..... 131/328
5,240,016 A * 8/1993 Nichols et al. ..... 131/335
5,247,947 A * 9/1993 Clearman et al. ..... 131/194
5,271,419 A * 12/1993 Arzonico et al. ..... 131/365
5,348,027 A * 9/1994 Barnes et al. ..... 131/194
6,857,431 B2 * 2/2005 Deevi et al. ..... 131/334
2002/0166563 A1 * 11/2002 Jupe et al. ..... 131/331
2003/0159704 A1 * 8/2003 Cibort et al. ..... 131/360

* cited by examiner

*Primary Examiner*—Carlos Lopez
(74) *Attorney, Agent, or Firm*—Jeffrey Weiss; Harry M. Weiss; Weiss & Moy, P.C.

(57) ABSTRACT

Selectively tobacco shortened cigarettes are disclosed, which have a multiplicity of components including a shortened butt and an inner tube for reinforcing a casing of the selectively tobacco shortened cigarette. Selectively tobacco shortened cigarettes have an extinguishing gap region to limit burning of the selectively tobacco shortened cigarette. Selectively tobacco shortened cigarettes are either filtered or unfiltered. Selectively tobacco shortened filtered cigarettes include a filter covering, which is contiguous with a casing. Selectively tobacco shortened unfiltered cigarettes have a perforated intake cover to prevent tobacco from spilling into other interior portions of the selectively tobacco shortened unfiltered cigarette. Selectively tobacco shortened filtered cigarettes with vents having a multiplicity of holes are suitable for lessening the desire to smoke. An improved method for lessening the desire to smoke is achieved by using selectively tobacco shortened filtered cigarettes with vents having a multiplicity of holes where shortened butts are decreased in length, which results in a smoker still feeling as though a cigarette is being smoked, even though the amount of smoked tobacco in the cigarette is actually decreased. This method helps a smoker quit smoking.

6 Claims, 2 Drawing Sheets

SELECTIVELY TOBACCO SHORTENED CIGARETTE AND METHOD OF USE

FIELD OF THE INVENTION

This invention relates generally to cigarettes, and more specifically to, selectively tobacco shortened cigarettes and methods for lessening the desire to smoke cigarettes.

BACKGROUND OF THE INVENTION

In the past, cigarettes of various kinds were available for smoking. These included cigarettes that were full strength and that were either filtered or unfiltered. In addition, "light" cigarettes were also available and usually included filters that lowered levels of tar and nicotine.

It was also common for cigarettes to be partially smoked and these cigarettes were often discarded when the smoker needed to enter a non-smoking environment. Depending on the method of discarding, it was possible for a partially smoked cigarette to smolder, causing further second hand smoke. In some cases, a discarded cigarette could be responsible for a secondary fire.

Currently, cigarette smoking has become more restricted. However, many smokers continue to smoke cigarettes, and continue to discard partially smoked cigarettes. This often occurs when a smoker takes a "break" while being at work in a smoking permitted area or outdoors. Smoking has also been restricted in other public gathering situations, such as restaurants, convention meetings and airports. Once again, smokers wanting to smoke, will go to a permitted area or outside and often partially smoke a cigarette. Partially smoked cigarettes are wasteful and costly to smokers. They also pose a risk to the environment, especially when not extinguished.

Furthermore, many smokers have a desire to quit smoking for obvious health reasons and the large amount of publicity regarding the hazards of smoking. A number of techniques have been used with mixed success, including use of nicotine-impregnated patches, chewing gums, substitutions for tobacco and hypnotism, amongst others.

Often smokers feel as though they need to have something in their hand and mouth to replace the cigarette that they no longer are smoking. Other smokers notice increasing weight gains because of a substitution of smoking by consuming more food. For various reasons, the desire to smoke becomes so powerful that many smokers revert to smoking again.

For the foregoing reasons, there is a need to provide cigarettes that can be used for short smoking sessions such as during "breaks", that are limited in how long they stay lighted after being discarded, and such cigarettes should help to lessen the desire to smoke.

SUMMARY OF THE INVENTION

Accordingly, it is an object of this invention to provide a selectively tobacco shortened cigarette.

It is a further object of this invention to provide a selectively tobacco shortened cigarette, which appears to be a conventional cigarette.

It is a further object of this invention to provide a selectively tobacco shortened cigarette, which is either filtered or unfiltered, and still appear to be a conventional cigarette.

It is a still further object of this invention to provide an improved method for lessening the desire to smoke.

It is still a further object of this invention to provide a method for lessening the desire to smoke, which utilizes selectively tobacco shortened cigarettes, which appear to be conventional cigarettes.

PREFERRED EMBODIMENTS OF THE INVENTION

In accordance with one embodiment of this invention, a selectively tobacco shortened cigarette comprises in combination, a conventionally sized cigarette casing having one end for insertion into a person's mouth and another end to be lit to permit generation of smoke to be inhaled by the person; and a shortened butt of tobacco type material having a length substantially less than the length of the conventionally sized cigarette casing located within a portion of the casing adjacent the another end to provide the person with a reduced amount of tobacco for smoking. The shortened butt is less than half the length of the selectively tobacco shortened cigarette. Alternatively, the shortened butt is less than 30% of the length of the selectively tobacco shortened cigarette. Alternatively, the shortened butt is less than 15% of the length of the selectively tobacco shortened cigarette. The casing has an inner tube located within an interior portion of the casing, for reinforcing the casing, the shortened butt of tobacco type material being surrounded by an annular butt casing located within the casing adjacent the another end of the casing. The selectively tobacco shortened cigarette includes an extinguishing gap region located adjacent to an inner end portion of the shortened butt to limit burning of portions of the selectively tobacco shortened cigarette that do not contain tobacco type material. The selectively tobacco shortened cigarette further comprises a filter located at the one end of the casing. The selectively tobacco shortened cigarette further comprises a perforated intake cover located at an inner end of the shortened butt for preventing tobacco from spilling out of the shortened butt. The selectively tobacco shortened cigarette includes a vent having a multiplicity of holes located in a portion of the casing for venting smoke before reaching the person's mouth thereby lessening the amount of smoke entering the person's mouth when smoking the selectively tobacco shortened filtered cigarette.

In accordance with a second embodiment of this invention, a method for providing a selectively shortened cigarette comprises the steps of providing a conventionally sized cigarette casing which has one end for insertion into a person's mouth and another end to be lit to permit generation of smoke to be inhaled by the person; and providing a shortened butt of tobacco type material having a length substantially less than the length of the conventionally sized cigarette casing located within a portion of the casing adjacent the another end to provide the person with a reduced amount of tobacco for smoking. The method further comprises the step of providing an inner tube located within an interior portion of the casing for reinforcing the casing, the shortened butt of tobacco type material being surrounded by an annular butt casing located within the casing adjacent the another end of the casing. The method further comprises the step of providing an extinguishing gap region located adjacent to an inner end portion of the shortened butt to limit burning of portions of the selectively tobacco shortened cigarette that do not contain tobacco type material. The method further comprises the step of providing a filter located at the one end of the casing. The method further comprises the step of providing a perforated intake cover located at an inner end of the shortened butt for preventing tobacco from spilling out of the shortened butt.

In accordance with a third embodiment of this invention, a method for lessening a person's desire to smoke comprises the steps of smoking an initial selectively tobacco shortened cigarette having a conventionally sized cigarette casing which has one end for insertion into a person's mouth and another end to be lit to permit generation of smoke to be inhaled by the person wherein a shortened butt of tobacco type material having a length substantially less than the length of the conventionally sized cigarette casing is located within a portion of the casing adjacent the another end to provide the person with a reduced amount of tobacco for smoking; and after a period of time smoking a different selectively tobacco shortened cigarette wherein the shortened butt of tobacco is further reduced to less than the reduced amount of tobacco of the initial selectively tobacco shortened cigarette to reduce a person's desire to smoke. The method further comprises the step of after still a further period of time smoking a further different selectively tobacco shortened cigarette wherein the shortened butt of tobacco is still further reduced to less than the amount of tobacco of the further different selectively tobacco shortened cigarette, the shortened butt of tobacco of the initial selectively tobacco shortened cigarette is less than half of the length of the initial selectively tobacco shortened cigarette, the shortened butt of tobacco of the different selectively tobacco shortened cigarette is less than 30% of the length of the different selectively tobacco shortened cigarette, the shortened butt of tobacco of the further different selectively tobacco shortened cigarette is less than 15% of the length of the further different selectively tobacco shortened cigarette. In the method the casing has an inner tube located within an interior portion of the casing for reinforcing the casing, the shortened butt of tobacco type material being surrounded by an annular butt casing located within the casing adjacent the another end of the casing. In the method the selectively tobacco shortened cigarette includes an extinguishing gap region located adjacent to an inner end portion of the shortened butt to limit burning of portions of the selectively tobacco shortened cigarette that do not contain tobacco type material. In the method the selectively tobacco shortened cigarette has a filter located at the one end of the casing. In the method the selectively tobacco shortened cigarette further comprises a vent having a multiplicity of holes located in a portion of the casing for venting smoke before reaching the person's mouth thereby lessening the amount of smoke entering the person's mouth when smoking the selectively tobacco shortened filtered cigarette.

The foregoing and other objects, features, and advantages of the invention will be apparent from the following, more detailed description of the preferred embodiments of the invention, as illustrated in the accompanying drawings.

DESCRIPTION OF THE INVENTION

Figures 1, 2, 3, 4, 5, 6:
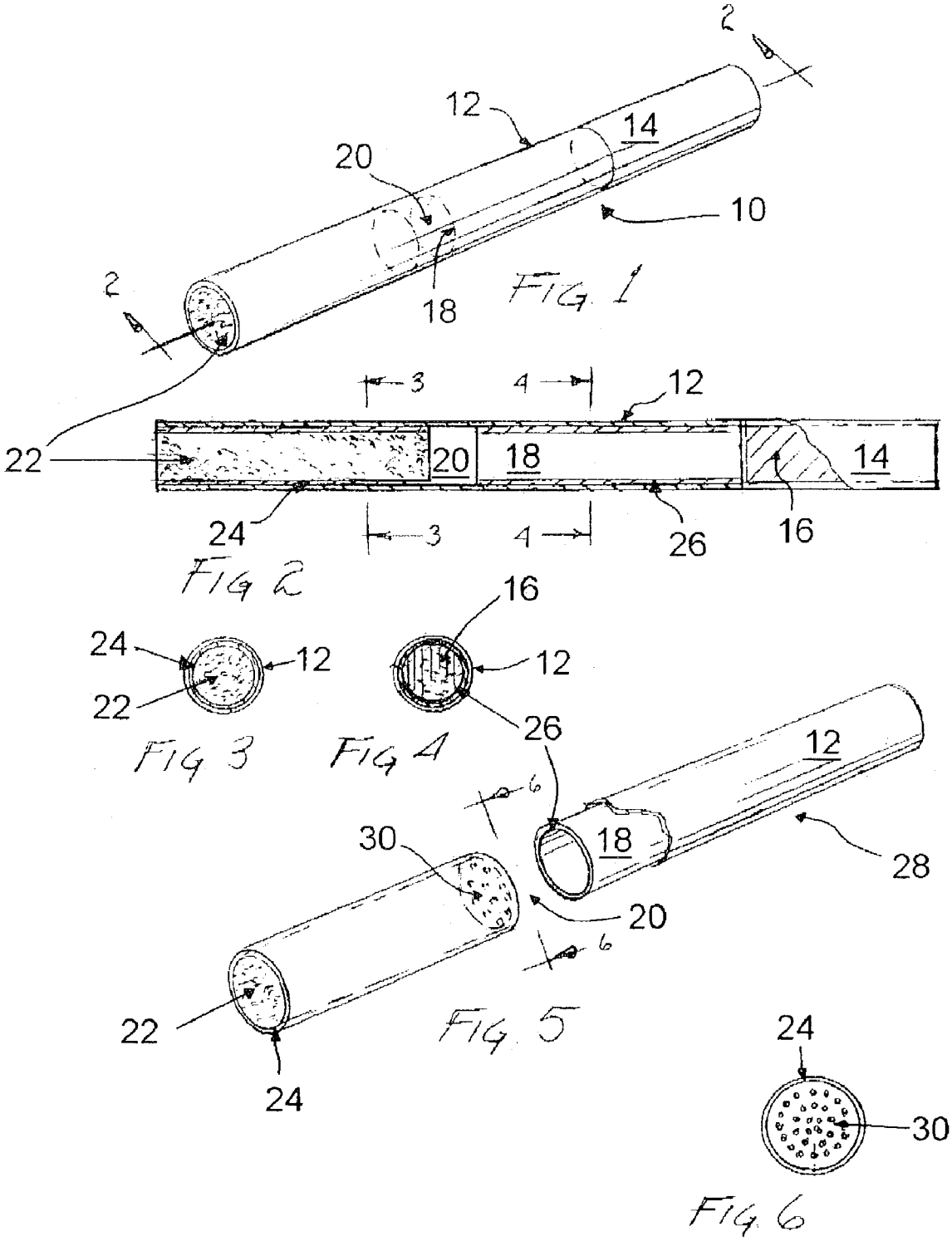
FIG. 1 is a perspective view of a selectively tobacco shortened filtered cigarette in accordance with this invention.
FIG. 2 is a sectional view taken through line 2-2 of FIG. 1 of the selectively tobacco shortened filtered cigarette.
FIG. 3 is a cross sectional view taken through line 3-3 of FIG. 1 of the selectively tobacco shortened filtered cigarette.
FIG. 4 is a cross sectional view taken through line 4-4 of FIG. 1 of the selectively tobacco shortened filtered cigarette.
FIG. 5 is a perspective view of an selectively tobacco shortened unfiltered cigarette.
FIG. 6 is a cross sectional view taken through line 5-5 of FIG. 5 of the selectively tobacco shortened unfiltered cigarette.

Referring to FIG. 1, a selectively tobacco shortened filtered cigarette 10 comprises a casing 12, a filter covering 14 contiguous with the casing 12 at one end of the selectively tobacco shortened filtered cigarette 10 and a multiplicity of internal components of the selectively tobacco shortened filtered cigarette 10, giving the appearance of a conventional filtered cigarette. The selectively tobacco shortened filtered cigarette 10 further comprises a filter 16 (FIGS. 1 and 2), which fits inside the filter covering 14 at the one end of the selectively tobacco shortened filtered cigarette 10 for insertion into a person's mouth. Additionally, the selectively tobacco shortened filtered cigarette 10 includes an inner tube 18 (FIGS. 1 and 2) having an end adjacent to an inner end of the filter 16, which fits within the casing 12. The inner tube 18 reinforces the casing 12 of the selectively tobacco shortened filtered cigarette 10. The selectively tobacco shortened filtered cigarette 10 also includes a short butt 22, which is preferably a portion of an unfiltered conventional cigarette of smaller radial dimensions than the casing 12. The short butt 22 fits inside the casing 12 at another end of the selectively tobacco shortened filtered cigarette 10 (FIGS. 1 and 2) that is to be lit to permit generation of smoke to be inhaled by the person. The selectively tobacco shortened filtered cigarette 10 has an extinguishing gap region 20. The extinguishing gap region 20 is adjacent to an inner end of the short butt 22 of the selectively tobacco shortened filtered cigarette 10. The extinguishing gap region 20 is also adjacent to an opposite end of the inner tube 18 of the selectively tobacco shortened filtered cigarette 10. The extinguishing gap region 20 limits burning of portions of the selectively tobacco shortened cigarette 10 that do not contain tobacco type. The length of the extinguishing gap region 20 (FIGS. 1 and 2) is pictorially exaggerated for clarity. The lengths of the inner tube 18 and the short butt 22 may be altered to suit the smoking time of the selectively tobacco shortened filtered cigarette 10. The total length of the filter 16, the short butt 22, the inner tube 18 and the extinguishing gap region 20 of the selectively tobacco shortened filtered cigarette 10 contained within the casing 12 and the contiguous outer cylindrical filter covering 14 of the selectively tobacco shortened filtered cigarette 10 give the appearance of a conventional cigarette.

FIG. 2 is a cross-sectional view taken through line 2-2 of FIG. 1, to more clearly show internal locations of the internal components of the selectively tobacco shortened filtered cigarette 10. The short butt 22 is at the another end of the selectively tobacco shortened filtered cigarette 10 and the inner end of the short butt 22 is adjacent to the extinguishing gap region 20 of the selectively tobacco shortened filtered cigarette 10. The extinguishing gap region 20 of the selectively tobacco shortened filtered cigarette 10 is adjacent to the opposite end of the inner tube 18 of the selectively tobacco shortened filtered cigarette 10. The end of the inner tube 18 is adjacent to the inner end of the filter 16, which is inside the outer filter covering 14 and at the one end of the selectively tobacco shortened filtered cigarette 10.

FIG. 3 is a cross-sectional view taken through line 3-3 of FIG. 1 of the selectively tobacco shortened filtered cigarette 10. The short butt 22 of the selectively tobacco shortened filtered cigarette 10 comprises tobacco surrounded by an annular butt casing 24. The short butt casing 24 and tobacco of the short butt 22 fit inside the casing 12.

FIG. 4 is a cross-sectional view taken through line 4-4 of FIG. 1 of the selectively tobacco shortened filtered cigarette 10. The inner tube 18 of the selectively tobacco shortened filtered cigarette 10 comprises an annular tube wall 26, which fits inside the casing 12. In FIG. 4 the filter 16 is visible at the inner end of the inner tube 18.

According to FIG. 5, a selectively tobacco shortened unfiltered cigarette 28 comprises a casing 12 and a multiplicity of internal components of the selectively tobacco shortened unfiltered cigarette 28 giving the appearance of a conventional unfiltered cigarette. The selectively tobacco shortened unfiltered cigarette 28 comprises an inner tube 18 that is shorter than the total length of the selectively tobacco shortened unfiltered cigarette 28. The inner tube 18 extends from one end of the selectively tobacco shortened unfiltered cigarette 28 within the casing 12 of the selectively tobacco shortened unfiltered cigarette 28 for insertion into a person's mouth at the one end. The inner tube 18 of the selectively tobacco shortened filtered cigarette 10 further comprises an annular tube wall 26, which fits inside the casing 12. The selectively tobacco shortened unfiltered cigarette 28 further comprises a short butt 22 at another end of the selectively tobacco shortened unfiltered cigarette 28 to be lit to permit generation of smoke to be inhaled by the person. The short butt 22 is preferably a portion of an unfiltered conventional cigarette of smaller radial dimensions than the casing 12. The short butt 22 includes tobacco surrounded by an annular butt casing 24 and has a perforated intake cover 30. The perforated intake cover 30 is located at an inner end of the short butt 22 of the selectively tobacco shortened unfiltered cigarette 28. The selectively tobacco shortened unfiltered cigarette 28 has an extinguishing gap region 20 for limiting burning of portions of the selectively tobacco shortened unfiltered cigarette 28 that do not contain tobacco type material. The perforated intake cover 30 of the short butt 22 is adjacent to the extinguishing gap region 20. The extinguishing gap region 20 is also adjacent to an opposite end of the inner tube 18 of the selectively tobacco shortened unfiltered cigarette 28. The lengths of the inner tube 18 and short butt 22 are adjustable to accommodate different smoking times. The total length of the short butt 22, the inner tube 18 and the extinguishing gap region 20 of the selectively tobacco shortened unfiltered cigarette 28 contained within the casing 12 of the selectively tobacco shortened unfiltered cigarette 28 give the appearance of a conventional unfiltered cigarette.

FIG. 6 is a cross-sectional view taken through line 6-6 of FIG. 5 of the selectively tobacco shortened unfiltered cigarette 28. In FIG. 6 the perforated intake cover 30 is located at the inner end of the short butt 22 of the selectively tobacco shortened unfiltered cigarette 28. The perforated intake cover 30 prevents tobacco from spilling out of the short butt 22 into the extinguishing gap region 20 and from there into the inner tube 18, eventually ending up in the mouth of the smoker. As an alternative embodiment of the selectively tobacco shortened filter cigarette 10 a perforated intake cover 30 could also be included at the inner end of the short butt 22 of the selectively tobacco shortened filtered cigarette 10.

Figure 7:
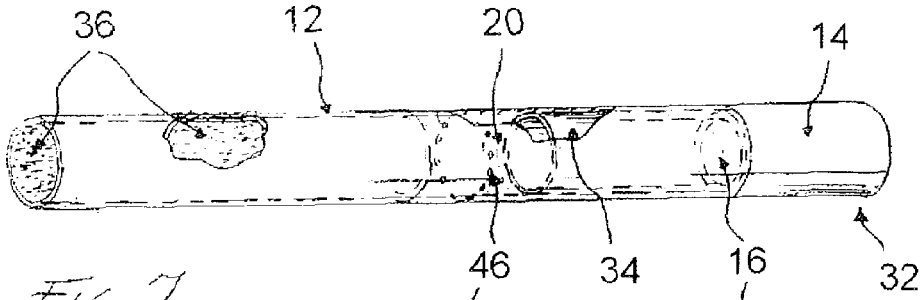
FIG. 7 is a perspective view of a selectively shortened filtered cigarette suitable for lessening a desire to smoke in accordance with this invention.

FIG. 7 is a perspective view of a selectively shortened filtered cigarette 32 suitable for lessening a desire to smoke. The selectively shortened filtered cigarette 32 comprises a casing 12, a filter covering 14 contiguous with the casing 12 at one end of the selectively shortened filtered cigarette 32 and a multiplicity of internal components of the selectively shortened filtered cigarette 32, giving the appearance of a conventional filtered cigarette. The selectively shortened filtered cigarette 32 further comprises a filter 16, which fits inside the filter covering 14 at the one end of the selectively tobacco shortened filtered selectively shortened filtered cigarette 32 for insertion into a person's mouth. Additionally, the selectively shortened filtered cigarette 32 includes a short length inner tube 34 having an end adjacent to an inner end of the filter 16 of the selectively shortened filtered cigarette 32, which fits inside the casing 12. The short length inner tube 34 reinforces the casing 12 of the selectively shortened filtered cigarette 32. The selectively shortened filtered cigarette 32 also includes a long length butt 36 comprising tobacco surrounded by an annular butt casing 24. The long length butt 36 is preferably a portion of an unfiltered conventional cigarette of smaller radial dimensions than the casing 12. The long length butt 36 fits inside the casing 12 at another end of the selectively shortened filtered cigarette 32 that is to be lit to permit generation of smoke to be inhaled by the person. The selectively shortened filtered cigarette 32 has an extinguishing gap region 20. An inner end of the long length butt 36 of the selectively shortened filtered cigarette 32 is adjacent to the extinguishing gap region 20. The extinguishing gap region 20 is also adjacent to an opposite end of the short length inner tube 34 of the selectively shortened filtered cigarette 32. The extinguishing gap region 20 limits burning of portions of the selectively shortened filtered cigarette 32 that do not contain tobacco type material. The length of the extinguishing gap region 20 is pictorially exaggerated for clarity. The selectively shortened filtered cigarette 32 has a radial vent 46 having a multiplicity of holes in a portion of the casing 12 for venting smoke before reaching a person's mouth lessening the amount of smoke entering the person's mouth when smoking the selectively shortened filtered cigarette 32. The total length of the filter 16, the long length butt 36, the short length inner tube 34 and the extinguishing gap region 20 of the selectively shortened filtered cigarette 32 contained within the casing 12 and the filter covering 14 of the selectively shortened filtered cigarette 32 give the appearance of a conventional cigarette.

Figure 8:
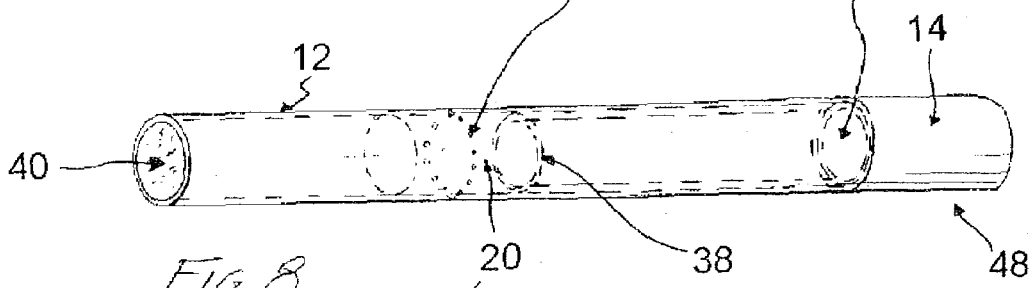
FIG. 8 is a perspective view of a selectively shortened filtered cigarette suitable for lessening a desire to smoke similar to FIG. 7 except that the tobacco portion is decreased relative to FIG. 7.

Referring to FIG. 8, a selectively shortened filtered cigarette 48 suitable for lessening a desire to smoke similar to the selectively shortened filtered cigarette 32, except that the tobacco portion is decreased compared to the selectively shortened filtered cigarette 32, also comprises a casing 12, a filter covering 14 contiguous with the casing 12 at one end of the selectively shortened filtered cigarette 48 and a multiplicity of internal components of the selectively shortened filtered cigarette 48, giving the appearance of a conventional filtered cigarette. The selectively shortened filtered cigarette 48 further comprises a filter 16, which fits inside the filter covering 14 at an open end of the selectively shortened filtered cigarette 48. However, the long length butt 36 of the previously described selectively shortened filtered cigarette 32 is replaced by an intermediate length butt 40 comprising tobacco surrounded by an annular butt casing 24. Similarly, the short length inner tube 34 of the previously described selectively shortened filtered cigarette 32 is replaced by an intermediate length inner tube 38. All other features of the construction of the selectively shortened filtered cigarette 32 including the selectively shortened filtered cigarette 32 having an extinguishing gap region 20 that limits burning of portions of the selectively shortened filtered cigarette 32 that do not contain tobacco type material and a portion of the casing 12 including a vent 46 having a multiplicity of holes in a portion of the casing 12 are the same for the selectively shortened filtered cigarette 48.

Figure 9:
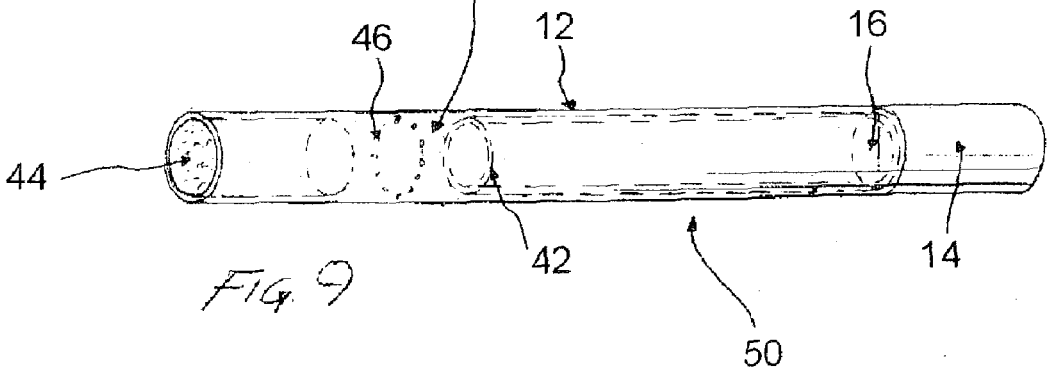
FIG. 9 is a perspective view of a selectively shortened filtered cigarette suitable for lessening a desire to smoke similar to FIG. 7 except that the tobacco portion is further decreased relative both to FIG. 7 and FIG. 8.

Referring to FIG. 9, a selectively shortened filtered cigarette 50 suitable for lessening a desire to smoke similar to both cigarettes 32 and 48, except that the tobacco portion is decreased compared to both cigarettes 32 and 48, also comprises a casing 12, a filter covering 14 contiguous with the casing 12 at one end of the selectively shortened filtered cigarette 50 and a multiplicity of internal components of the selectively shortened filtered cigarette 50, giving the appearance of a conventional filtered cigarette. The selectively shortened filtered cigarette 50 further comprises a filter 16 tightly bound inside the filter covering 14 at an open end of the selectively shortened filtered cigarette 50. However, the intermediate length butt 40 of the previously described selectively shortened filtered cigarette 48 is replaced by a short length butt 44 comprising tobacco surrounded by an annular butt casing 24. Similarly, the intermediate length inner tube 38 of the previously described selectively shortened filtered cigarette 48 is replaced by a long length inner tube 42. All other features of the construction of the selectively shortened filtered cigarette 48 including the selectively shortened filtered cigarette 48 having an extinguishing gap region 20 that limits burning of portions of the selectively shortened filtered cigarette 48 that do not contain tobacco type material and a portion of the casing 12 including a vent 46 having a multiplicity of holes in a portion of the casing 12 are the same for the selectively shortened filtered cigarette 50.

FIGS. 7, 8 and 9 illustrate a method for lessening the desire to smoke. A smoker begins the smoke lessening program by using cigarettes 32. Unlike conventional cigarettes the actual amount of smoked tobacco in the cigarette is decreased because of the combination of a long length butt 36, a short length inner tube 34 and a vent 46 having a multiplicity of holes. After a period of time, the smoker begins using cigarettes 48 having the combination of an intermediate length butt 40, an intermediate length inner tube 38 and a vent 46 having a multiplicity of holes, resulting in an even lesser amount of smoked tobacco in the cigarette reaching the smoker's mouth compared to the selectively shortened filtered cigarette 32. After another period of time, the smoker begins using cigarettes 50 having the combination of a short length butt 44, a long length inner tube 42 and a vent 46 having a multiplicity of holes, resulting in an even lesser amount of smoked tobacco in the cigarette reaching the smoker's mouth compared to the selectively shortened filtered cigarette 48. This procedure has the advantage that a smoker still feels as though a cigarette is being smoked, even though the amount of smoked tobacco in the cigarette is actually decreased. Depending on the desire of a smoker to quit smoking, this procedure helps a smoker take the next step of entirely quitting smoking.

In summary, the present invention is directed to selectively tobacco shortened cigarettes, which appear to be conventional cigarettes. Selectively tobacco shortened cigarettes have a multiplicity of components including a shortened butt and an inner tube for reinforcing a casing of the selectively tobacco shortened cigarette. Selectively tobacco shortened cigarettes have an extinguishing gap region that limits burning of portions of the selectively shortened cigarette that do not contain tobacco type material. Selectively tobacco shortened cigarettes are either filtered or unfiltered. Selectively tobacco shortened filtered cigarettes include a filter covering, which is contiguous with a casing. Selectively tobacco shortened unfiltered cigarettes have a perforated intake cover to prevent tobacco from spilling into other interior portions of the selectively tobacco shortened unfiltered cigarette. Selectively tobacco shortened filtered cigarettes with vents having a multiplicity of holes are suitable for lessening the desire to smoke. An improved method for lessening the desire to smoke is achieved by using selectively tobacco shortened filtered cigarettes with vents having a multiplicity of holes where shortened butts are decreased in length, which results in a smoker still feeling as though a cigarette is being smoked, even though the amount of smoked tobacco in the cigarette is actually decreased. This method helps a smoker quit smoking.

While the invention has been particularly shown and described with reference to preferred embodiments thereof, it will be understood by those skilled in the art that the foregoing and other changes in form and details may be made therein without departing from the spirit and scope of the invention. For example, selectively shortened filtered cigarettes of the type described above for lessening the desire to smoke could also have a perforated intake cover at the inner end of the variable length butt. Selectively shortened filtered cigarettes of the type described above for lessening the desire to smoke could also be unfiltered if desired. Materials of the cigarette components could also be altered including the substitution of non-tobacco material for tobacco.

What is claimed is:

1. A selectively tobacco shortened cigarette comprising, in combination:

a conventionally sized cigarette casing having a first end for insertion into a person's mouth and a second end to be lit to permit generation of smoke to be inhaled by the person;

a filter covering proximate said first end and contiguous with said casing;

a filter adapted to fit inside said filter covering;

an inner tube having an end adjacent to an inner end of said filter, adapted to fit within said casing for reinforcing said casing;

a shortened butt of tobacco material having a length substantially less than the length of said conventionally sized cigarette casing and smaller radial dimensions than said casing, wherein said shortened butt fits inside said casing adjacent said second end of said selectively tobacco shortened cigarette to provide the person with a reduced amount of tobacco for smoking;

an extinguishing gap region adjacent to an inner end of said shortened butt of said selectively tobacco shortened cigarette to limit burning of portions of said selectively tobacco shortened cigarette that do not contain tobacco material; and a perforated intake cover located at an inner end of said shortened butt for preventing tobacco from spilling out of said shortened butt.

2. A selectively tobacco shortened cigarette comprising, in combination:

a conventionally sized cigarette casing having a first end for insertion into a person's mouth and a second end to be lit to permit generation of smoke to be inhaled by the person;

a filter covering proximate said first end and contiguous with said casing;

a filter adapted to fit inside said filter covering;

an inner tube having an end adjacent to an inner end of said filter, adapted to fit within said casing for reinforcing said casing;

a shortened butt of tobacco material having a length substantially less than the length of said conventionally sized cigarette casing and smaller radial dimensions than said casing, wherein said shortened butt fits inside said casing adjacent said second end of said selectively tobacco shortened cigarette to provide the person with a reduced amount of tobacco for smoking;

an extinguishing gap region adjacent to an inner end of said shortened butt of said selectively tobacco shortened cigarette to limit burning of portions of said selectively tobacco shortened cigarette that do not contain tobacco material; and a vent having a multiplicity of holes located in a portion of said casing for venting smoke before reaching the person's mouth thereby lessening the amount of smoke entering the person's mouth when smoking said selectively tobacco shortened filtered cigarette.

3. A method for providing a selectively tobacco shortened cigarette comprising the steps of:

providing a conventionally sized casing which has a first end for insertion into a person's mouth and a second end to be lit to permit generation of smoke to be inhaled by the person;

providing a filter covering proximate said first end and contiguous with said casing;

providing a filter adapted to fit inside said filter covering;

providing an inner tube having an end adjacent to an inner end of said filter, adapted to fit within said casing for reinforcing said casing;

providing a shortened butt of tobacco material having a length substantially less than the length of said conventionally sized casing and smaller radial dimensions than said casing, wherein said shortened butt fits inside said casing adjacent said second end of said selectively tobacco shortened cigarette to provide the person with a reduced amount of tobacco for smoking;

providing an extinguishing gap region adjacent to an inner end of said shortened butt of said selectively tobacco shortened cigarette to limit burning of portions of said selectively tobacco shortened cigarette that do not contain tobacco material; and providing a perforated intake cover located at an inner end of said shortened butt for preventing tobacco from spilling out of said shortened butt.

4. A method for lessening a person's desire to smoke comprising the steps of:

smoking an initial selectively tobacco shortened cigarette having:

a conventionally sized cigarette casing which has a first end for insertion into a person's mouth and a second end to be lit to permit generation of smoke to be inhaled by the person, wherein a filter covering is proximate said first end and contiguous with said casing, wherein a filter is adapted to fit inside said filter covering, wherein an inner tube having an end adjacent to an inner end of said filter is adapted to fit within said casing for reinforcing said casing, wherein a shortened butt of tobacco material having a length substantially less than the length of said conventionally sized cigarette casing and smaller radial dimensions than said casing, wherein said shortened butt fits inside said casing adjacent said second end of said selectively tobacco shortened cigarette to provide the person with a reduced amount of tobacco for smoking, and wherein an extinguishing gap region is adjacent to an inner end of said shortened butt of said selectively tobacco shortened cigarette to limit burning of portions of said selectively tobacco shortened cigarette that do not contain tobacco material; and after a period of time smoking a different selectively tobacco shortened cigarette wherein said shortened butt of tobacco is further reduced to less than the reduced amount of tobacco of said initial selectively tobacco shortened cigarette to reduce a person's desire to smoke.

5. The method for lessening a person's desire to smoke according to claim 4 further comprising the step of: after still a further period of time smoking a further different selectively tobacco shortened cigarette wherein said shortened butt of tobacco is still further reduced to less than the amount of tobacco of said further different selectively tobacco shortened cigarette, said shortened butt of tobacco of said initial selectively tobacco shortened cigarette is less than half of the length of said selectively tobacco shortened cigarette, said shortened butt of tobacco of said different selectively tobacco shortened cigarette is less than 30% of the length of said different selectively tobacco shortened cigarette, said shortened butt of tobacco of said further different selectively tobacco shortened cigarette is less than 15% of the length of said further different selectively tobacco shortened cigarette.

6. The method for lessening a person's desire to smoke according to claim 4 wherein said selectively tobacco shortened cigarette further comprises a vent having a multiplicity of holes located in a portion of said casing for venting smoke before reaching the person's mouth thereby lessening the amount of smoke entering the person's mouth when smoking said selectively tobacco shortened filtered cigarette.

* * * * *